US009324521B2

(12) United States Patent
Nakayama et al.

(10) Patent No.: US 9,324,521 B2
(45) Date of Patent: Apr. 26, 2016

(54) POWER SWITCHGEAR

(75) Inventors: Yuta Nakayama, Chiyoda-ku (JP); Tomotaka Yano, Chiyoda-ku (JP); Taehyun Kim, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 165 days.

(21) Appl. No.: 13/818,837

(22) PCT Filed: Oct. 6, 2011

(86) PCT No.: PCT/JP2011/073070

§ 371 (c)(1),
(2), (4) Date: Feb. 25, 2013

(87) PCT Pub. No.: WO2012/086293

PCT Pub. Date: Jun. 28, 2012

(65) Prior Publication Data

US 2013/0146565 A1 Jun. 13, 2013

(30) Foreign Application Priority Data

Dec. 20, 2010 (JP) ..... 2010-282924

(51) Int. Cl.
*H01H 33/666* (2006.01)
*H01H 33/00* (2006.01)
(Continued)

(52) U.S. Cl.
CPC ..... *H01H 33/666* (2013.01); *H01H 1/50* (2013.01); *H01H 3/3026* (2013.01); *H01H 33/006* (2013.01); *H01H 33/6662* (2013.01)

(58) Field of Classification Search
CPC ..... H01H 33/006; H01H 33/666; H01H 33/6662; H01H 1/50; H01H 3/3026; H01H 33/02; H01H 33/38; H01H 33/42; H01H 3/00; H02B 13/02
USPC ..... 218/7, 43, 78, 120, 141, 154; 335/104, 335/105, 151, 171, 193
See application file for complete search history.

(56) References Cited

U.S. PATENT DOCUMENTS 6,020,567 A 2/2000 Ishikawa et al.
(Continued)

FOREIGN PATENT DOCUMENTS

CN 1892955 A 1/2007
EP 0 704 872 A1 4/1996
(Continued)

OTHER PUBLICATIONS

International Search Report (PCT/ISA/210) issued on Dec. 27, 2011, by the Japanese Patent Office as the International Searching Authority for International Application No. PCT/JP2011/073070.
(Continued)

*Primary Examiner* — Renee Luebke
*Assistant Examiner* — William Bolton
(74) *Attorney, Agent, or Firm* — Buchanan Ingersoll & Rooney PC

(57) ABSTRACT

A vacuum valve includes a fixed side electrode on a fixed side current-carrying shaft and a movable side electrode on a movable side current-carrying shaft. An opening and closing unit is coaxially disposed with the movable side current-carrying shaft, and drives the movable side current-carrying shaft. A chattering suppression structure is coaxially disposed with the fixed side current-carrying shaft on the fixed side of the vacuum valve, and suppresses chattering. The opening and closing unit includes an electromagnetic operating mechanism which drives the movable side current-carrying shaft when energized. A contact pressure spring is coaxially disposed with the electromagnetic operating mechanism, and applies contact pressure between the movable side electrode and the fixed side electrode during contact closing of the vacuum valve. A release spring is coaxially disposed with the electromagnetic operating mechanism, and assists driving force of the electromagnetic operating mechanism during contact opening of the vacuum valve.

5 Claims, 2 Drawing Sheets

(51) Int. Cl.
*H01H 3/30* (2006.01)
*H01H 1/50* (2006.01)

(56) References Cited

U.S. PATENT DOCUMENTS

| | | | | |
|---|---|---|---|---|
| 6,373,675 | B1 * | 4/2002 | Yamazaki et al. | 361/135 |
| 8,426,759 | B2 * | 4/2013 | Nagatake et al. | 218/140 |
| 8,680,956 | B2 * | 3/2014 | Kim et al. | 335/179 |
| 2004/0104201 | A1 * | 6/2004 | Sato et al. | 218/118 |
| 2012/0169441 | A1 * | 7/2012 | Kim et al. | 335/179 |
| 2012/0312667 | A1 * | 12/2012 | Hasegawa et al. | 200/288 |

FOREIGN PATENT DOCUMENTS

| | | | |
|---|---|---|---|
| JP | 5-190063 | A | 7/1993 |
| JP | 5-083978 | A | 11/1993 |
| JP | 7-320604 | A | 12/1995 |
| JP | 11-072179 | A | 3/1999 |
| JP | 2000-299041 | A | 10/2000 |
| JP | 2002-124157 | A | 4/2002 |
| JP | 2002-124165 | A | 4/2002 |
| JP | 2004-241204 | A | 8/2004 |
| JP | 2006-269202 | A | 10/2006 |
| JP | 2008-084718 | A | 4/2008 |

OTHER PUBLICATIONS

Office Action issued on Nov. 18, 2014, by the Chinese Patent Office in corresponding Chinese Patent Application No. 201180051365.1, and an English Translation of the Office Action. (10 pages).

* cited by examiner (a)

(b)

POWER SWITCHGEAR

TECHNICAL FIELD

The present invention relates to a power switchgear such as a vacuum circuit breaker for use in electric power transmission/distribution and reception/distribution facilities.

BACKGROUND ART

In a known power switchgear, a vacuum valve is configured by containing a fixed contact and a movable contact disposed with a predetermined distance spaced apart from the fixed contact in a vacuum vessel. The movable contact is coupled to a coupling rod of an electromagnetic operating mechanism via an insulating member and a contact pressure spring. The coupled vacuum valves and the electromagnetic operating mechanisms are disposed for three phases in parallel to each other with a predetermined distance spaced and are contained in a containing box.

Furthermore, a spring receiver is fixed at a lower end portion of the coupling rod and a coil shaped release spring serving as a spring member is put in a compressed state between a yoke of the electromagnetic operating mechanism and the spring receiver; and accordingly, spring force of a downward contact opening direction is applied to the coupling rod via the spring receiver during a contact opening operation so as to assist driving force during the contact opening.

In the structure of such known power switchgear, three units of the operating mechanisms are placed on one base plate; the vacuum valve, the contact pressure spring, the electromagnetic operating mechanism, and the release spring are coaxially arranged; and these coaxially arranged components are disposed for three phases in parallel to each other with a predetermined distance spaced and are contained in the containing box. This structure accelerates the contact opening speed of a movable element of the vacuum valve; and thus, electromagnetic force of the electromagnetic operating mechanism and force of the release spring are added. (See, for example, Patent Document 1.)

Furthermore, in other known power switchgear, vacuum valves and a release spring are coaxially arranged; the vacuum valves are disposed for three phases in parallel to each other with a predetermined distance spaced; and main circuit insulating frames insulate between respective phases. One driving shaft, which is disposed in a direction perpendicular to axial directions of the three phase vacuum valves and passes through movable shafts of the three phase vacuum valves, is provided and this one driving shaft pivots by an electromagnetic operating device coupled to the driving shaft; and accordingly, the respective movable shafts of the three phase vacuum valves are driven collectively, and opening and closing of fixed contacts and movable contacts of the three phase vacuum valves is performed collectively in three phases. (See, for example, Patent Document 2.)

RELATED ART DOCUMENT

Patent Document

Patent Document 1: Japanese Unexamined Patent Publication No. 2008-84718 (FIG. 4)

Patent Document 2: Japanese Unexamined Patent Publication No. H7-320604 (FIG. 1)

DISCLOSURE OF THE INVENTION

Problems to be Solved by the Invention

In the aforementioned known power switchgear, three units of the operating mechanisms are placed on one base plate; the vacuum valve, the contact pressure spring, the electromagnetic operating mechanism, and the release spring are coaxially arranged; and these coaxially arranged components are disposed for three phases in parallel to each other with a predetermined distance spaced and are contained in the containing box. Therefore, chattering phenomenon, which repeats contacts generated between the movable contact and the fixed contact of the vacuum valve in a vibrating manner during a contact closing operation of the vacuum valve, receives the influence of other phase via the base plate; and thus, chattering suppression is difficult.

Furthermore, in the other known power switchgear, the vacuum valves and the release spring are coaxially arranged; the vacuum valves are disposed for three phases in parallel to each other with a predetermined distance spaced; one driving shaft, which passes through the movable shafts of the three phase vacuum valves in the direction perpendicular to the axial directions of the three phase vacuum valves, is provided; and this one driving shaft pivots by the electromagnetic operating device coupled to the driving shaft. Accordingly, the respective movable shafts of the three phase vacuum valves are driven collectively, and opening and closing of the fixed contacts and the movable contacts of the three phase vacuum valves is performed collectively in three phases to open and close the vacuum valves simultaneously in three phases. Therefore, it is difficult to deal with a phase control power switchgear which is capable of opening and closing each phase at a specific phase at which a switching surge is low.

The present invention has been made to solve the foregoing problem and is to provide a power switchgear which is capable of suppressing the influence of chattering and capable of dealing with a single phase, three phases, and phase control.

Means for Solving the Problems

According to the present invention, there is provided a power switchgear including: a pressure tank in which both end opening portions are sealed by a movable side base plate and a fixed side base plate, and insulating gas is filled; a vacuum valve which is contained inside the pressure tank, and in which a fixed side electrode provided on a fixed side current-carrying shaft and a movable side electrode provided on a movable side current-carrying shaft coaxially disposed with the fixed side current-carrying shaft are configured to be capable of being connected and disconnected; an opening and closing unit which is coaxially disposed with the movable side current-carrying shaft via an insulating rod connected to the movable side current-carrying shaft outside the pressure tank, and drives the movable side current-carrying shaft; and a chattering suppression structure which is coaxially disposed with the fixed side current-carrying shaft on the fixed side of the vacuum valve, and suppresses chattering generated between the movable side electrode and the fixed side electrode during contact closing of the vacuum valve. The opening and closing unit includes: an electromagnetic operating mechanism which drives the movable side current-carrying shaft via the insulating rod by being energized; a contact pressure spring which is coaxially disposed with the electromagnetic operating mechanism, and applies contact pressure between the movable side electrode and the fixed side electrode by being compressed after the movable side electrode comes into contact with the fixed side electrode during contact closing of the vacuum valve; and a release spring which is coaxially disposed with the electromagnetic operating mechanism, and assists driving force of the electromagnetic operating mechanism during contact opening of the vacuum valve.

A power switchgear according to the present invention includes: a pressure tank in which insulating gas is filled; a vacuum valve which is contained inside the pressure tank, and in which a fixed side electrode provided on a fixed side current-carrying shaft and a movable side electrode provided on a movable side current-carrying shaft coaxially disposed with the fixed side current-carrying shaft are configured to be capable of being connected and disconnected; an opening and closing unit which is coaxially disposed with the movable side current-carrying shaft via an insulating rod connected to the movable side current-carrying shaft outside the pressure tank, and drives the movable side current-carrying shaft; and a chattering suppression structure which is coaxially disposed with the fixed side current-carrying shaft on the fixed side of the vacuum valve, and suppresses chattering generated between the movable side electrode and the fixed side electrode during contact closing of the vacuum valve. The opening and closing unit includes: an electromagnetic operating mechanism which drives the movable side current-carrying shaft via the insulating rod by being energized; a contact pressure spring which is coaxially disposed with the electromagnetic operating mechanism, and applies contact pressure between the movable side electrode and the fixed side electrode by being further compressed after the movable side electrode comes into contact with the fixed side electrode during contact closing of the vacuum valve; a release spring which is disposed in parallel to the electromagnetic operating mechanism, and assists driving force of the electromagnetic operating mechanism during contact opening of the vacuum valve; and a linking mechanism which is coupled to the electromagnetic operating mechanism and the release spring, and applies driving force to the release spring by actuation of the electromagnetic operating mechanism.

Advantageous Effect of the Invention

According to a power switchgear of the present invention, there can be obtained a power switchgear which is capable of suppressing the influence of chattering and capable of dealing with a single phase, three phases, and phase control.

MODE FOR CARRYING OUT THE INVENTION

Embodiment 1

Figure 1:
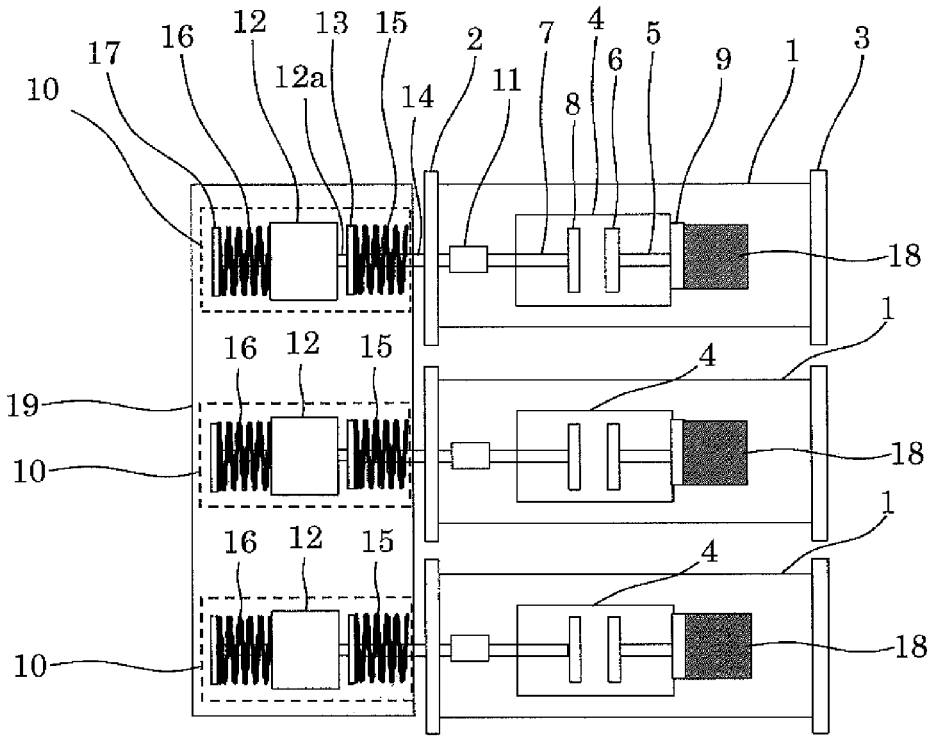
FIG. 1 is a sectional view showing a power switchgear according to Embodiment 1 of the present invention.

Hereinafter, Embodiment 1 of the present invention will be described with reference to FIG. 1. Then, in the drawing, identical or equivalent members and portions will be described with the same reference numerals assigned thereto.

FIG. 1 is a sectional view showing a power switchgear according to Embodiment 1 of the present invention.

In FIG. 1, a pressure tank 1 of each phase is electrically grounded; both end opening portions are sealed by a movable side base plate 2 and a fixed side base plate 3 and insulating gas is filled; and, for example, insulating gas such as dry air, nitrogen, or carbonic anhydride, which is substantially zero in global warming potential and effective for global warming prevention, is filled as the insulating gas.

Vacuum valves 4 are each contained inside the pressure tank 1; and a fixed side electrode 6 provided on a fixed side current-carrying shaft 5 and a movable side electrode 8 provided on a movable side current-carrying shaft 7 coaxially disposed with the fixed side current-carrying shaft 5 are configured to be capable of being connected and disconnected. A fixed side end plate 9 connected to the fixed side current-carrying shaft 5 is provided on the fixed side of the vacuum valve 4.

Opening and closing units 10 are each disposed outside the pressure tank 1 corresponding to each vacuum valve 4, coaxially disposed with the movable side current-carrying shaft 7 via an insulating rod 11 connected to the movable side current-carrying shaft 7 of the vacuum valve 4, and disposed so as to drive the movable side current-carrying shaft 7.

These opening and closing units 10 are each configured as follows. The opening and closing unit 10 includes: an electromagnetic operating mechanism 12 which drives a driving shaft 12*a* toward the vacuum valve 4 by energizing an excitation coil (not shown in the drawing) disposed inside, and drives the movable side current-carrying shaft 7 via a spring receiver 13 engaged with the driving shaft 12*a*, an operating shaft 14 coupled to the spring receiver 13, and the insulating rod 11 coupled to the operating shaft 14 and the movable side current-carrying shaft 7; a contact pressure spring 15 which is coaxially disposed with the electromagnetic operating mechanism 12, and applies contact pressure between the movable side electrode 8 and the fixed side electrode 6 by being further compressed after the movable side electrode 8 comes into contact with the fixed side electrode 6 during contact closing of the vacuum valve 4; and a release spring 16 which is coaxially disposed with the electromagnetic operating mechanism 12, and assists the driving force of the electromagnetic operating mechanism 12 during contact opening of the vacuum valve 4.

Incidentally, a configuration is made such that the contact pressure spring 15 is compressed by the spring receiver 13 that is moved toward the vacuum valve 4 by the driving shaft 12*a* of the electromagnetic operating mechanism 12, and the contact pressure between the movable side electrode 8 and the fixed side electrode 6 is applied by biasing force due to the compression.

Furthermore, a configuration is made such that the release spring 16 accumulates biasing force by being compressed during a contact closing operation of the vacuum valve 4 by a spring receiver 17 connected to the other end portion of the driving shaft 12*a* of the electromagnetic operating mechanism 12; and an accumulation state of the biasing force is released during a contact opening operation of the vacuum valve 4, and the movable side electrode 8 operates so as to be promptly separated from the fixed side electrode 6 by the accumulated biasing force to perform auxiliary action of the electromagnetic operating mechanism 12.

Then, a chattering suppression structure 18, which is coaxially disposed with the fixed side current-carrying shaft 5 on the fixed side end plate 9 that is the fixed side of the vacuum valve 4 and suppresses chattering generated between the movable side electrode 8 and the fixed side electrode 6 during contact closing of the vacuum valve 4, is provided. Incidentally, the respective opening and closing units 10 are covered by, for example, one operating box 19.

Next, operation will be described. In the contact closing operation of the vacuum valve 4, the excitation coil (not shown in the drawing) incorporated in the electromagnetic operating mechanism 12 is energized; and accordingly, the driving shaft 12*a* of the electromagnetic operating mechanism 12 is driven toward the vacuum valve 4; and the movable side current-carrying shaft 7 is driven via the spring receiver 13 engaged with the driving shaft 12*a*, the operating shaft 14 coupled to the spring receiver 13, and the insulating rod 11 coupled to the operating shaft 14 and the movable side current-carrying shaft 7.

The movable side current-carrying shaft 7 of the vacuum valve 4 is driven; and accordingly, the movable side electrode 8 of the vacuum valve 4 comes into contact with the fixed side electrode 6. Then, after the movable side electrode 8 comes into contact with the fixed side electrode 6, the movable side current-carrying shaft 7 is further pressed by the contact pressure spring 15, the contact pressure between the movable side electrode 8 and the fixed side electrode 6 is further applied, and the contact closing operation is completed.

Chattering generated between the movable side electrode 8 and the fixed side electrode 6 during contact closing of the vacuum valve 4 can be suppressed by the chattering suppression structure 18 coaxially disposed with the fixed side current-carrying shaft 5 on the fixed side endplate 9 that is the fixed side of the vacuum valve 4.

As described above, in each phase of three phases, the vacuum valve 4 contained in the pressure tank 1 and the opening and closing unit 10 coaxially disposed via the operating shaft 14 and the insulating rod 11 connected to the movable side current-carrying shaft 7 of the vacuum valve 4 are placed on the movable side base plate 2 of each pressure tank 1, and each phase is an independent single phase power switchgear; and therefore, it becomes difficult to be influenced by chattering due to an opening and closing operation of other phase's vacuum valve 4 and thus suppression of the chattering can be easily performed.

Furthermore, during the contact closing operation of the vacuum valve 4, the excitation coil (not shown in the drawing) incorporated in the electromagnetic operating mechanism 12 is energized; and accordingly, for example, the release spring 16 is compressed to energy-store the biasing force by the spring receiver 17 connected to the other end portion of the driving shaft 12*a* of the electromagnetic operating mechanism 12. That is, the biasing force is energy-stored in the release spring 16 during contact closing of the vacuum valve 4; and therefore, energization to the excitation coil (not shown in the drawing) incorporated in the electromagnetic operating mechanism 12 is stopped during the contact opening operation of the vacuum valve 4 and accordingly the movable side current-carrying shaft 7 of the vacuum valve 4 is made to movably move so as to separate the movable side electrode 8 from the fixed side electrode 6. However, an energy-stored state of the biasing force of the release spring 16 is released, the movable side electrode 8 operates so as to be promptly separated from the fixed side electrode 6 by the biasing force energy-stored in the release spring 16, and the contact opening operation of the vacuum valve 4 is completed.

By the way, three units of the opening and closing units 10 disposed for respective phases are placed outside the pressure tank 1 and three units of the opening and closing units 10 are covered by one operating box 19; and therefore, a reduction in size, simplification, and a reduction in cost of the operating box 19 can be achieved.

Furthermore, in the aforementioned known power switchgear disclosed in Patent Document 2, one driving shaft, which passes through the movable shafts of the three phase vacuum valves in the direction perpendicular to the axial directions of the three phase vacuum valves, is provided and this one driving shaft pivots by the electromagnetic operating device coupled to the driving shaft; accordingly, the respective movable shafts of the three phase vacuum valves are driven collectively, and opening and closing of the fixed contacts and the movable contacts of the three phase vacuum valves is performed collectively in three phases to open and close the vacuum valves simultaneously in three phases; and therefore, large components such as the driving shaft coupled in three phases are needed. On the contrary, in the power switchgear of Embodiment 1, the opening and closing unit 10 is disposed for each phase; and therefore, large components such as the driving shaft coupled in three phases are not needed. Thus, mechanical drive components of the opening and closing unit 10 are minimized, reliability as a driving device of the power switchgear is improved, and a reduction in size can be achieved.

Furthermore, a module of each phase in a three phase switchgear is the same; and therefore, the opening and closing unit 10 can be assembled for each unit of each phase, productivity is improved, and a reduction in cost can be achieved.

In addition, in Embodiment 1, in each phase of three phases, the vacuum valve 4 contained in the pressure tank 1 and the opening and closing unit 10 coaxially disposed via the operating shaft 14 and the insulating rod 11 connected to the movable side current-carrying shaft 7 of the vacuum valve 4 are placed on the movable side base plate 2 of each pressure tank 1, and each phase is the independent single phase power switchgear; and therefore, it becomes possible to deal with as a phase control power switchgear while suppressing chattering by performing control of timing of the opening and closing operation of the opening and closing unit 10 of each phase.

Embodiment 2

Figure 2:
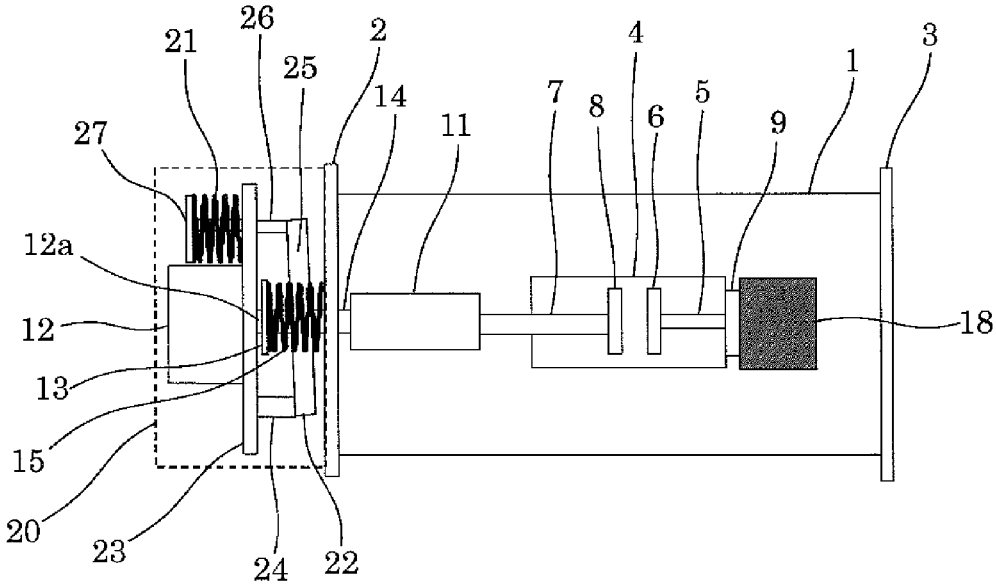
FIG. 2 is a sectional view showing a power switchgear according to Embodiment 2 of the present invention.
Figure 3:
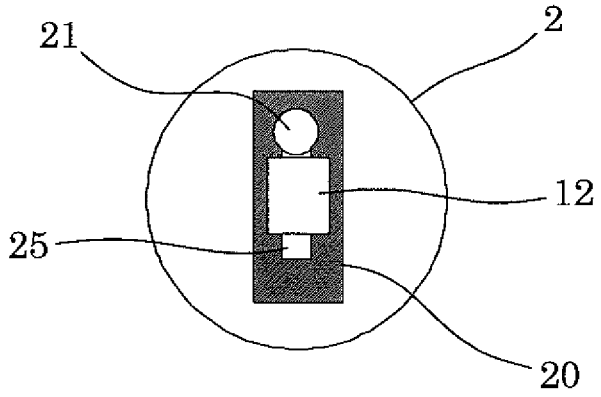
FIGS. 3(*a*), 3(*b*) are views each showing a mounting direction of a release spring and a lever of an opening and closing unit in the power switchgear according to Embodiment 2 of the present invention.
Figure 3:
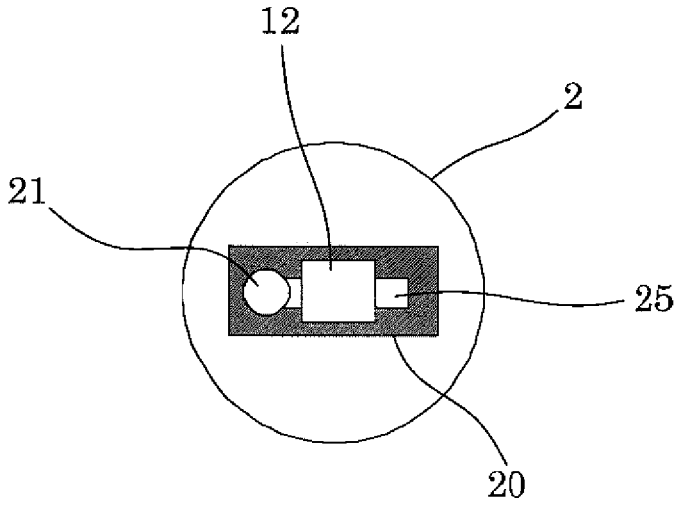

Embodiment 2 of the present invention will be described with reference to FIG. 2 and FIGS. 3(*a*), 3(*b*). Then, in each of the drawings, identical or equivalent members and portions will be described with the same reference numerals assigned thereto. FIG. 2 is a sectional view showing a power switchgear according to Embodiment 2 of the present invention. FIGS. 3(*a*), 3(*b*) are views each showing a mounting direction of a release spring and a lever of an opening and closing unit in the power switchgear according to Embodiment 2 of the present invention.

In Embodiment 2, the power switchgear includes: a pressure tank 1 in which both end opening portions are sealed by a movable side base plate 2 and a fixed side base plate 3, and insulating gas is filled; a vacuum valve 4 which is contained inside the pressure tank 1, and in which a fixed side electrode 6 provided on a fixed side current-carrying shaft 5 and a movable side electrode 8 provided on a movable side current-carrying shaft 7 coaxially disposed with the fixed side current-carrying shaft 5 are configured to be capable of being connected and disconnected; an opening and closing unit 20 which is coaxially disposed with the movable side current-carrying shaft 7 via an insulating rod 11 connected to the movable side current-carrying shaft 7 outside the pressure tank 1, and drives the movable side current-carrying shaft 7; and a chattering suppression structure 18 which is coaxially disposed with the fixed side current-carrying shaft 5 on a fixed side end plate 9 that is the fixed side of the vacuum valve 4, and suppresses chattering generated between the movable side electrode 8 and the fixed side electrode 6 during contact closing of the vacuum valve 4.

Basic configuration is similar to the aforementioned Embodiment 1; however, the opening and closing unit 20 in Embodiment 2 is configured as follows. The opening and closing unit 20 includes: an electromagnetic operating mechanism 12 which drives a driving shaft 12*a* toward the vacuum valve 4 by energizing an excitation coil (not shown in the drawing) disposed inside, and drives the movable side current-carrying shaft 7 via a spring receiver 13 engaged with the driving shaft 12*a*, an operating shaft 14 coupled to the spring receiver 13, and the insulating rod 11 coupled to the operating shaft 14 and the movable side current-carrying shaft 7; a contact pressure spring 15 which is coaxially disposed with the electromagnetic operating mechanism 12, and applies contact pressure between the movable side electrode 8 and the fixed side electrode 6 by being further compressed after the movable side electrode 8 comes into contact with the fixed side electrode 6 during contact closing of the vacuum valve 4; a release spring 21 which is disposed in parallel to the electromagnetic operating mechanism 12, and assists the driving force of the electromagnetic operating mechanism 12 during contact opening of the vacuum valve 4; and a linking mechanism 22 which is coupled to the electromagnetic operating mechanism 12 and the release spring 21, and applies driving force to the release spring 21 by actuation of the electromagnetic operating mechanism 12.

The linking mechanism 22 is configured such that, for example, a support 24 is provided on a base 23 attached to the electromagnetic operating mechanism 12, one side of a lever body 25 is mounted on the support 24 on a pivot, one side of a support rod 26 is mounted on the other side of the lever body 25 on a pivot, a spring receiver 27 that receives the release spring 21 is mounted on the other side of the support rod 26, and a central portion of the lever body 25 is mounted on the operating shaft 14 on a pivot.

Incidentally, as in the aforementioned Embodiment 1, a configuration is made such that the contact pressure spring 15 is compressed by the spring receiver 13 that is moved toward the vacuum valve 4 by the driving shaft 12*a* of the electromagnetic operating mechanism 12, and the contact pressure between the movable side electrode 8 and the fixed side electrode 6 is applied by biasing force due to the compression.

Furthermore, the release spring 21 in Embodiment 2 is configured as follows. The driving shaft 12*a* of the electromagnetic operating mechanism 12 is driven toward the vacuum valve 4; and accordingly, the operating shaft 14 also moves toward the vacuum valve 4. The central portion of the lever body 25 of the linking mechanism 22 moves toward the vacuum valve 4 in conjunction with the operating shaft 14 by the movement of the operating shaft 14, and the other side of the lever body 25 pivots to the right side in FIG. 2 using one side thereof mounted on the support 24 on a pivot as a fulcrum. By this pivot, the support rod 26 mounted on the other side of the lever body 25 on a pivot moves toward the vacuum valve 4. The support rod 26 moves toward the vacuum valve 4 and accordingly the release spring 21 is compressed to accumulate biasing force during a contact closing operation of the vacuum valve 4 by the spring receiver 27 connected on the other side of the support rod 26; whereas, during a contact opening operation of the vacuum valve 4, an accumulation state of the biasing force is released and the movable side electrode 8 acts so as to be promptly separated from the fixed side electrode 6 by the accumulated biasing force to perform auxiliary action of the electromagnetic operating mechanism 12.

As described above, the release spring 21 is placed in parallel to the electromagnetic operating mechanism 12; accordingly, the range of a placing location of the release spring 21 is enlarged and the length of the lever body 25 of the linking mechanism 22 and the selecting range of types of the release spring 21 are also enlarged; and therefore, necessary release speed can be easily obtained. Furthermore, the axial dimension is shortened; and therefore, a reduction in size of an operating box 19 can also be achieved.

By the way, description has been made on the case where the release spring 21 of the opening and closing unit 20 and the lever body 25 of the linking mechanism 22 are vertically arranged as shown in FIG. 3(*a*), but is not limited thereto. For example, as shown in FIG. 3(*b*), the release spring 21 and the lever body 25 may be mounted to be arranged horizontally by being rotated 90 degrees.

As described above, the mounting direction of the release spring 21 and the lever body 25 of the linking mechanism 22 of the opening and closing unit 20 is capable of being rotated 90 degrees; and accordingly, effects are achieved in that wiring of the electromagnetic operating mechanism 12 and the mounting position of a gas system during filling insulating gas can be diversified.

Further, mechanical drive components such as the lever body 25 are minimized, reliability as a driving device of the power switchgear is improved, and a reduction in size can be achieved.

Furthermore, according to Embodiment 2, it goes without saying that the aforementioned effects are exhibited and similar effects to the aforementioned Embodiment 1 are exhibited by disposing the power switchgear shown in FIG. 2 for three phases.

INDUSTRIAL APPLICABILITY

The present invention is suitable to actualize a power switchgear which is capable of suppressing the influence of chattering and capable of dealing with a single phase, three phases, and phase control.

The invention claimed is:

1. A power switchgear comprising:

a pressure tank in which insulating gas is filled;

a vacuum valve which is contained inside said pressure tank, and in which a fixed side electrode provided on a fixed side current-carrying shaft and a movable side electrode provided on a movable side current-carrying shaft coaxially disposed with the fixed side current-carrying shaft are configured to be capable of being connected and disconnected;

an opening and closing unit which is coaxially disposed with the movable side current-carrying shaft via an insulating rod connected to the movable side current-carrying shaft outside of said pressure tank, and drives the movable side current-carrying shaft; and a chattering suppression structure which is coaxially disposed with the fixed side current-carrying shaft on the fixed side of said vacuum valve, and suppresses chattering generated between the movable side electrode and the fixed side electrode during contact closing of said vacuum valve, wherein said opening and closing unit includes:

an electromagnetic operating mechanism which drives the movable side current-carrying shaft via the insulating rod by being energized;

a contact pressure spring which is coaxially disposed with said electromagnetic operating mechanism, and which is further compressed after the movable side electrode comes into contact with the fixed side electrode during contact closing of said vacuum valve, to apply contact pressure between the movable side electrode and the fixed side electrode;

a release spring which is disposed in parallel to said electromagnetic operating mechanism, and assists driving force of said electromagnetic operating mechanism during contact opening of said vacuum valve; and a linking mechanism comprising a lever which is pivotally coupled to said electromagnetic operating mechanism and said release spring, and applies driving force to said release spring by actuation of said electromagnetic operating mechanism.

2. The power switchgear according to claim 1, wherein three units of said power switchgear are used as a three phase power switchgear.

3. The power switchgear according to claim 2, wherein a module of said electromagnetic operating mechanism of said power switchgear is the same in three phases.

4. The power switchgear according to claim 2, wherein phase control of an opening and closing operation of each phase power switchgear can be performed.

5. The power switchgear according to claim 3, wherein phase control of an opening and closing operation of each phase power switchgear can be performed.

* * * * *